US007558393B2

(12) United States Patent
Miller, III

(10) Patent No.: US 7,558,393 B2
(45) Date of Patent: Jul. 7, 2009

(54) SYSTEM AND METHOD FOR COMPATIBLE 2D/3D (FULL SPHERE WITH HEIGHT) SURROUND SOUND REPRODUCTION

(76) Inventor: Robert E. Miller, III, 606 W. Broad, Bethlehem, PA (US) 18018

( * ) Notice: Subject to any disclaimer, the term of this patent is extended or adjusted under 35 U.S.C. 154(b) by 970 days.

(21) Appl. No.: 10/802,924

(22) Filed: Mar. 18, 2004

(65) Prior Publication Data

US 2004/0247134 A1 Dec. 9, 2004

Related U.S. Application Data

(60) Provisional application No. 60/455,497, filed on Mar. 18, 2003.

(51) Int. Cl.
*H04R 5/00* (2006.01)
*H04R 5/02* (2006.01)

(52) U.S. Cl. ..... 381/307; 381/17; 381/18; 381/300; 381/20; 381/27; 381/1

(58) Field of Classification Search ..... 381/17, 381/307, 309, 310, 19–20, 22–23, 1, 18, 381/300, 303, 304, 27
See application file for complete search history.

(56) References Cited

U.S. PATENT DOCUMENTS

| | | | | |
|---|---|---|---|---|
| 5,594,800 | A * | 1/1997 | Gerzon | 381/20 |
| 7,231,054 | B1 * | 6/2007 | Jot et al. | 381/310 |
| 2002/0172370 | A1 * | 11/2002 | Ito | 381/18 |

* cited by examiner

*Primary Examiner*—Vivian Chin
*Assistant Examiner*—George C Monikang
(74) *Attorney, Agent, or Firm*—Duane Morris LLP

(57) ABSTRACT

A system and method of producing an output sound field that is representative of an input sound field compatible with both existing prior art sound reproduction systems, for example ITU 5.1/6.1, and with a three-dimensional reproduction system unique to this disclosure. One embodiment of the disclosed system is comprised of a microphone array, an encoder, a decoder, and a plurality of speakers, some of which may not be located in the plane of the listener. A further embodiment discloses matrices to encode and decode the signals representative of the input and output sound fields respectively.

39 Claims, 10 Drawing Sheets

FIG 4A

| Mode "I" (inclined) | | | | | | | 4x4 coefs x 0.8500 |
|---|---|---|---|---|---|---|---|
| °Up° | {Si} \ | {Pin}: FL | FR | W | X | Y | Z |
| 0 | {Sout}: L | 0.850 | 0.000 | | | | |
| 0 | R | 0.000 | 0.850 | | | | |
| 30 | C | | | 0.601 | 0.736 | 0 | 0.425 |
| 30 | SC | | | 0.601 | -0.736 | 0 | 0.425 |
| -30 | SL | | | 0.601 | -0.368 | 0.638 | -0.425 |
| -30 | SR | | | 0.601 | -0.368 | -0.638 | -0.425 |
| min/max rec | Transformation {S} 4x4 or 6x6 | | | W=0.707W | cosAcosE | sinAcosE | sinE |

FIG 4B

| Mode "J" (juxtaposed I; descending C) | | | | | | | |
|---|---|---|---|---|---|---|---|
| °Up° | {Sj} \ | {Pin}: FL | FR | W | X | Y | Z |
| 0 | {Sout}: L | 0.850 | 0.000 | | | | |
| 0 | R | 0.000 | 0.850 | | | | |
| -30 | C | | | 0.601 | 0.736 | 0 | -0.425 |
| -30 | SC | | | 0.601 | -0.736 | 0 | -0.425 |
| 30 | SL | | | 0.601 | -0.368 | 0.638 | 0.425 |
| 30 | SR | | | 0.601 | -0.368 | -0.638 | 0.425 |
| min/max rec | Transformation {S} 4x4 or 6x6 | | | W=0.707W | cosAcosE | sinAcosE | sinE |

FIG 4C

| Mode "k" (on it's back) | | | | | | | |
|---|---|---|---|---|---|---|---|
| °Up° | {Sk} \ | {Pin}: FL | FR | W | X | Y | Z |
| 0 | {Sout}: L | 0.850 | 0.000 | | | | |
| 0 | R | 0.000 | 0.850 | | | | |
| 30 | C | | | 0.601 | 0.736 | 0 | 0.425 |
| 60 | SC | | | 0.601 | -0.425 | 0 | 0.736 |
| 0 | SL | | | 0.601 | -0.425 | 0.736 | 0.000 |
| 0 | SR | | | 0.601 | -0.425 | -0.736 | 0.000 |
| min/max rec | Transformation {S} 4x4 or 6x6 | | | W=0.707W | cosAcosE | sinAcosE | sinE |

FIG 4D

| Mode *i' high tilted* | | | | | | | |
|---|---|---|---|---|---|---|---|
| °Up° | {Si'} \ | {Pin}: FL | FR | W | X | Y | Z |
| -30 | {Sout}: L | 0.850 | 0.000 | | | | |
| -30 | R | 0.000 | 0.850 | | | | |
| 0 | C | | | 0.601 | 0.850 | 0 | 0.000 |
| 60 | SC | | | 0.601 | -0.425 | 0 | 0.736 |
| 0 | SL | | | 0.601 | -0.531 | 0.638 | -0.184 |
| 0 | SR | | | 0.601 | -0.531 | -0.638 | -0.184 |
| min/max rec | Transformation {S'} 4x4 or 6x6 | | | W=0.707W | cosAcosE | sinAcosE | sinE |

FIG 4E

| Mode *j' high tilted* | | | | | | | |
|---|---|---|---|---|---|---|---|
| °Up° | {Sj'} \ | {Pin}: FL | FR | W | X | Y | Z |
| -30 | {Sout}: L | 0.850 | 0.000 | | | | |
| -30 | R | 0.000 | 0.850 | | | | |
| -60 | C | | | 0.601 | 0.425 | 0 | -0.736 |
| 0 | SC | | | 0.601 | -0.850 | 0 | 0.000 |
| 60 | SL | | | 0.601 | -0.106 | 0.638 | 0.552 |
| 60 | SR | | | 0.601 | -0.106 | -0.638 | 0.552 |
| min/max rec | Transformation {S'} 4x4 or 6x6 | | | W=0.707W | cosAcosE | sinAcosE | sinE |

FIG 4F

| Mode *k' high tilted* | | | | | | | |
|---|---|---|---|---|---|---|---|
| °Up° | {Sk'} \ | {Pin}: FL | FR | W | X | Y | Z |
| -30 | {Sout}: L | 0.850 | 0.000 | | | | |
| -30 | R | 0.000 | 0.850 | | | | |
| 0 | C | | | 0.601 | 0.850 | 0 | 0.000 |
| 90 | SC | | | 0.601 | 0.000 | 0 | 0.850 |
| 30 | SL | | | 0.601 | -0.368 | 0.736 | 0.213 |
| 30 | SR | | | 0.601 | -0.368 | -0.736 | 0.213 |
| min/max rec | Transformation {S'} 4x4 or 6x6 | | | W=0.707W | cosAcosE | sinAcosE | sinE |

--{TU 6.1-to-PerAmbio reconstitution--> {B} noise degradation dB 1.41

| {Pi} \ {Sout}: | L | R | C | SC | SL | SR | {Pout} |
|---|---|---|---|---|---|---|---|
| {Pout}: FL | 1.176 | 0.000 | | | | | 1.00 |
| FR | 0.000 | 1.176 | | | | | 1.00 |
| W | | | 0.624 | 0.208 | 0.416 | 0.416 | 0.71 |
| X | | | 0.679 | -0.679 | 0.000 | 0.000 | 0.50 |
| Y | | | 0 | 0 | 0.784 | -0.784 | 0.50 |
| Z | | | 0.294 | 0.882 | -0.588 | -0.588 | 0.50 |
| Reconstitute {P} | min/max | | -0.784 1.176 | | {Pout}-{Pin}= 0 | | {P}x{Sout} |

FIG 5A

--{TU 6.1-to-PerAmbio reconstitution--> {B} noise degradation dB 1.41

| {Pi} \ {Sout}: | L | R | C | SC | SL | SR | {Pout} |
|---|---|---|---|---|---|---|---|
| {Pout}: FL | 1.176 | 0.000 | | | | | 1.00 |
| FR | 0.000 | 1.176 | | | | | 1.00 |
| W | | | 0.624 | 0.208 | 0.416 | 0.416 | 0.71 |
| X | | | 0.679 | -0.679 | 0.000 | 0.000 | 0.50 |
| Y | | | 0 | 0 | 0.784 | -0.784 | 0.50 |
| Z | | | -0.294 | -0.882 | 0.588 | 0.588 | 0.50 |
| Reconstitute {P} | min/max | | -0.882 1.176 | | {Pout}-{Pin}= 0 | | {P}x{Sout} |

FIG 5B

--{TU 6.1-to-PerAmbio reconstitution--> {B} noise degradation dB 2.66

| {Pk} \ {Sout}: | L | R | C | SC | SL | SR | {Pout} |
|---|---|---|---|---|---|---|---|
| {Pout}: FL | 1.176 | 0.000 | | | | | |
| FR | 0.000 | 1.176 | | | | | |
| W | | | 0.609 | -0.352 | 0.703 | 0.703 | 0.71 |
| X | | | 0.861 | -0.497 | -0.182 | -0.182 | 0.50 |
| Y | | | 0 | 0 | 0.679 | -0.679 | 0.50 |
| Z | | | 0.000 | 1.358 | -0.679 | -0.679 | 0.50 |
| Reconstitute {P} | min/max | | -0.679 1.358 | | {Pout}-{Pin}= 0 | | {P}x{Sout} |

FIG 5C

--{TU 6.1-to-PerAmbio reconstitution--> {B} noise degradation dB 1.41

| {Pi} \ [Pout}: FL | {Sout}: L | R | C | SC | SL | SR | {Pout} |
|---|---|---|---|---|---|---|---|
| FR | 1.176 | 0.000 | | | | | 1.00 |
| W | 0.000 | 1.176 | | | | | 1.00 |
| X | | | 0.624 | 0.208 | 0.416 | 0.416 | 0.71 |
| Y | | | 0.735 | -0.147 | -0.294 | -0.294 | 0.50 |
| Z | | | 0 | 0 | 0.784 | -0.784 | 0.50 |
| | | | -0.085 | 1.104 | -0.509 | -0.509 | 0.50 |
| Reconstitute {P} | min/max | | -0.784 1.176 | | {Pout}-{Pin}= 0 | | {P}x{Sout} |

FIG 5D

--{TU 6.1-to-PerAmbio reconstitution--> {B} noise degradation dB 1.41

| {Pi} \ [Pout}: FL | {Sout}: L | R | C | SC | SL | SR | {Pout} |
|---|---|---|---|---|---|---|---|
| FR | 1.176 | 0.000 | | | | | 1.00 |
| W | 0.000 | 1.176 | | | | | 1.00 |
| X | | | 0.624 | 0.208 | 0.416 | 0.416 | 0.71 |
| Y | | | 0.441 | -1.029 | 0.294 | 0.294 | 0.50 |
| Z | | | 0 | 0 | 0.784 | -0.784 | 0.50 |
| | | | -0.594 | -0.425 | 0.509 | 0.509 | 0.50 |
| Reconstitute {P} | min/max | | -1.029 1.176 | | {Pout}-{Pin}= 0 | | {P}x{Sout} |

FIG 5E

--{TU 6.1-to-PerAmbio reconstitution--> {B} noise degradation dB 3.08

| {Pk} \ [Pout}: FL | {Sout}: L | R | C | SC | SL | SR | {Pout} |
|---|---|---|---|---|---|---|---|
| FR | 1.176 | 0.000 | | | | | 1.00 |
| W | 0.000 | 1.176 | | | | | 1.00 |
| X | | | 0.609 | -0.352 | 0.703 | 0.703 | 0.71 |
| Y | | | 0.746 | 0.249 | -0.497 | -0.497 | 0.50 |
| Z | | | 0 | 0 | 0.679 | -0.679 | 0.50 |
| | | | -0.431 | 1.425 | -0.497 | -0.497 | 0.50 |
| Reconstitute {P} | min/max | | -0.679 1.425 | | {Pout}-{Pin}= 0 | | {P}x{Sout} |

FIG 5F

SYSTEM AND METHOD FOR COMPATIBLE 2D/3D (FULL SPHERE WITH HEIGHT) SURROUND SOUND REPRODUCTION

BACKGROUND OF THE INVENTION

This application claims the priority of provisional application 60/455,497 filed 18 Mar. 2003 and is hereby incorporated herein by reference. The inventor's paper entitled "Scalable Tri-play Recording for Stereo, ITU 5.1/6.1 2D, and Periphonic 3D (with Height) Compatible Surround Sound Reproduction" presented at the 115$^{th}$ convention of the Audio Engineering Society in October of 2003 is hereby incorporated herein by reference in its entirety.

Lifelike reproduction of sound has long been a subject of scientific exploration and experimentation. While we may not have completed this exploration, we now know enough to record and reproduce a very good approximation of the lifelike sounds of, for example, musical performance in an acoustic space, and other applications. We do know that it is essential to preserve true three-dimensionality of the arrivals at the ear of both direct and reflected sounds, or close approximations of their directions of arrival. We say "true three-dimensionality" ("3D") because the term is much misused. For example, methods are often termed 3D where reproducers (e.g., loudspeakers) are arranged only in the horizontal plane. These methods can only reliably preserve horizontal angles of sound arrivals where the listener is at the center of a horizontal circle. However, in live listening in an acoustic space, reflections also arrive from above and below, at vertical angles of elevation, referred to as "height", and resulting in truly natural "periphonic" hearing.

For lifelike reproduction, there are both (a) important reasons why the most reliable way to reproduce height is by locating loudspeakers above and below the listener, who is now at the center of a sphere, not just a circle, and (b) important reasons why height must also be preserved in the first place.

Regarding point (a) above, in the past, less reliable methods have attempted to generalize an important aspect of human Head-Related Transfer Functions ("HRTF") using generalized filters or so-called "dummy-head" microphones, intended to deliver to inside the two ear canals of the listener what was recorded at the two ear canals of the dummy head. The problem is that the human mechanism for determining sound arrivals from above or below is the pinna, or outer ear. Folds of the pinna cause reflections of higher frequency sounds either partially to reinforce or partially to cancel, or attenuate, depending on both the frequency and the direction of the sound, both horizontal and vertical. But each human individual's pinna are as unique as a fingerprint, so generalized filters or generalized "dummy pinna" work more or less poorly for each listener. Miniature microphones placed within the ear canals of the recordist/listener result in more lifelike reproduction, but only with that one person doing the recording and/or listening.

For lifelike reproduction by a group of listeners—such as in listening to recorded music in a home theater, training in a simulator, or virtual reality for computer multi-media, or riding an amusement ride—loudspeakers must be located above and below as well as around the listeners. Each listener's pinna, in "agreement" with other aspects of their individual HRTF, will determine for them both the azimuth and elevation of each sound, just as they have learned these complex relationships for themselves since childhood.

Regarding point (b) above, why must true 3D (i.e., with height) be preserved in the first place? The reason is that humans learn sound directionality by relating seeing sources of sound with the hearing mechanisms described above. Through a complex ear-brain response the listener knows the direction of a sound—above or below as well as horizontally—even when facing another way or with eyes closed. In acoustic spaces, unseen reflections arrive at different times, building up to steady state, then collapse in the same order when the source of the sound stops. Each arrival and "departure" from each direction is tonally "colored" by the pinna. Musicians hear this same complex interplay and form each note, phrase, even pause, to be "musically correct", playing the acoustic as an extension of their instrument. The "tonality" or timbre of their guitar, piano, or violin would sound very different in a different space. They will play differently in a different hall to be musically correct in that hall, such as playing faster or more legato in a small space and slower and more pizzicato in a large one. Listeners in the same space learn this "musical language" and appreciate the music more when they agree it is correct. But take away height reflections from the ceiling or acoustic clouds above the stage and the timbre changes dramatically.

So for lifelike reproduction of natural sounds such as music, spherically positioned reproducers of sound are a requirement.

Numerous approaches termed "three-dimensional" are in fact only two-dimensional since they use speakers only in the horizontal plane. If the listener perceives any height sounds, they can only be due to the acoustics of the listening environment, which are invalid in reproducing the space where the music was recorded. Other approaches attempt to simulate height auditory "cues", or signals, to the ear-brain system, however these cannot be generalized reliably to life-like degree for all listeners because their pinna are as individual as their fingerprints, as described above. If the goal is to believably reproduce the recorded space, then the listener will believe he has been "transported" to that space and is no longer in the listening space. If the recorded space is an acoustic one with reflective ceiling and floor elements, lifelike believability requires vertically-arriving sounds to be preserved. Since we cannot successfully generalize pinna colorations (e.g., by using filters and/or dummy heads) that connote height, we can best reproduce height cues by using loudspeakers above and below the listeners. But an infinite number of loudspeakers and channels as in real life would be infinitely impractical.

Prior art systems, such as 1$^{st}$ Order Ambisonics, creates a reasonable approximation of three-dimensionality using four channels and a minimum of eight loudspeakers. Ambisonics has not succeeded in the marketplace for a variety of reasons, not the least of which is the fact that Ambisonics does not produce a lifelike reproduction of sound in front of the listener, where the ear-brain "perceptualization" is most acute.

Another prior art system, called Ambiophonics, uses a two-channel binaural-based approach that precisely positions sounds across a 120 degree arc in front of a listener where such localization is most important for lifelike hearing. In order to localize frontal sounds widely yet accurately, Ambiophonics uses two closely-spaced speakers, called a "stereo dipole" or "Ambiopole", and transaural crosstalk cancellation. However, Ambiosonics is inherently two-dimensional and incapable of producing three-dimensional sound with height.

Prior art monaural systems sounded correct tonally but had a "stage door" affect: it was localized at a point in 2D for coming through a narrow opening, say, in an orchestra shell wall. Prior art stereo systems, while providing spaciousness in sound in two dimensions, suffer from lack of localization as the speakers are typically placed as the front left and front right positions, thereby leaving a large gap between the speakers. Other prior art systems, such as ITU 5.1/6.1 and stereo, favor spaciousness and simulating tonality at the price of accurate localization—as though mutually exclusive. ITU 5.1/6.1 systems extend the stereo concept to envelop listeners but only in two dimensions. A height component is lacking.

Another prior art system is WaveField Synthesis ("WFS"). The WFS system is limited to two dimensions and therefore lacks the directionality of height and the natural timbral quality achievable by systems and methods exercising the present invention. Furthermore, WFS requires upwards of 36 speakers and is impractical at present in needing as many channels for distribution and digital signal processing as for reproduction.

Yet other prior art systems, known collectively as Higher Order Ambiosonics ("HOA") likewise have deficiencies. Along with the deficiencies previously noted for Ambiosonic systems, HOA systems require nine or more channels for Ambisonic components for a total of 11 or more distribution channels. Currently, six full-range channels is the current limitation of distribution media such as DVD-A, SACD, and DTS-CD.

No prior art systems have yet been able to reproduce accurate 3D sound—with height and accurate spaciousness, tonality, and localization. The present invention produces life-like 3D sound with correct spatial impression, timbre (tonality), and localization. Furthermore, embodiments of the present invention plays compatibly in stereo, ITU 5.1/6.1, full 3D using available 6-channel media, and full 3D using 10 or more speakers in a home theater or height-modified cinema.

It is an object of the present disclosure to provide a novel system and method for accurately reproducing a 3D sound field.

It is another object of the present disclosure to provide a novel system and method for combining accurate reproduction of "front stage sound" with accurate three-dimensional localization of sound to produce a sound field with height and accurate spaciousness, tonality, and localization.

It is yet another object of the present disclosure to provide a novel system and method for producing a signal which accurately reproduces a 3D sound field that is also capable of play back on current surround 2D sound systems without the use of a decoder or the need to add additional speakers.

It is still another object of the present disclosure to provide a novel system and method for providing a transformation matrix for mapping a 3D sound field into a signal for providing a 2D sound field without the need for a decoder.

It is still yet another object of the present disclosure to provide a novel system and method for providing a reconstitution matrix for accurately reproducing a 3D sound field.

It is a further object of the present disclosure to provide a novel system and method for a microphone array capable of capturing a sound field in three dimensions.

BRIEF DESCRIPTION OF THE DRAWINGS

FIGS. 2A-2C are a depiction of the top, front, and side views of an embodiment of a hybrid microphone array according to an aspect of the present disclosure.

FIGS. 4A-4F each depict one of the six 3D transform mode matrices of FIGS. 3A-3F, respectively.

FIGS. 5A-5F each depict one of the six reconstitution matrices of FIGS. 4A-4F, respectively.

DETAILED DESCRIPTION OF PREFERRED EMBODIMENTS

An embodiment of the present disclosure may comprise (a) a microphone array capable of capturing sounds in three dimensions and using, perhaps, six recording channels; (b) an encoder for "transformation" of recordings from the microphone array so that the captured sounds may be encoded on standard media such as compact discs ("CDs") or digital video discs ("DVDs") such that playing the media requires no decoder for replay on, for example, ITU 5.1/6.1 systems; (c) a decoder for lossless "reconstituting" of 3D information of the captured sounds for use with a 3D speaker layout; and (d) a speaker layout for 3D reproduction of the captured sounds, or a standard ITU 5.1/6.1 speaker layout. It shall be understood by those of skill in the art that the an ITU 5.1/6.1 system does not require a 3D speaker layout. The novel system and method are sometimes referred to herein as "PerAmbio 3D/2D" or simply "PerAmbio".

Figure 1A:
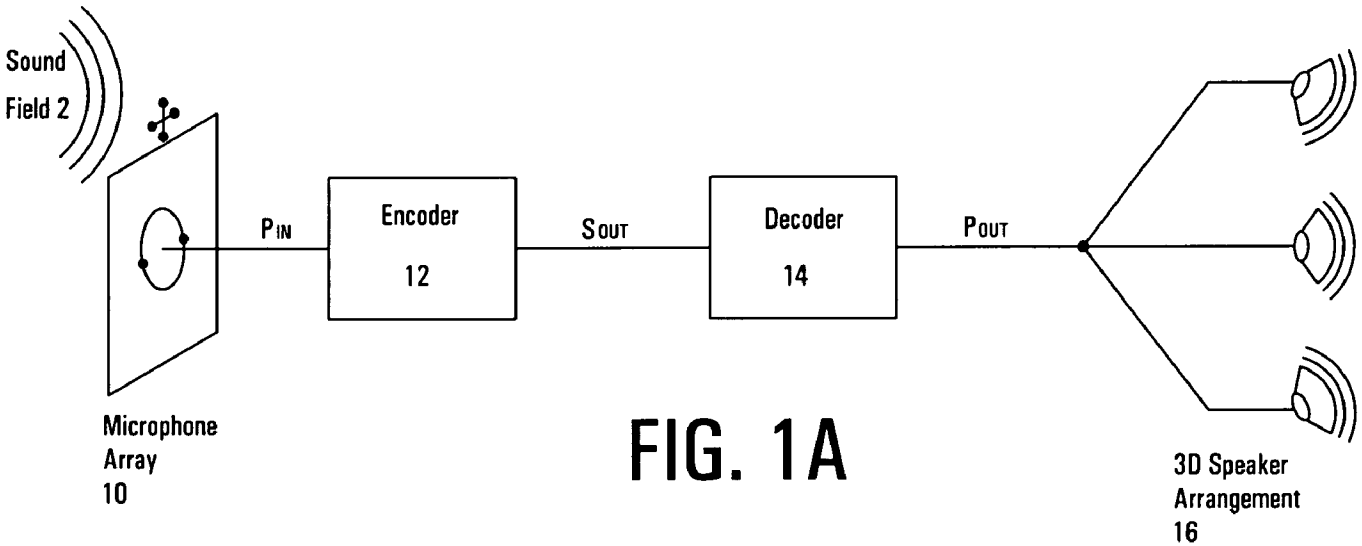
FIG. 1A is a high level block diagram illustrating the flow of information from a microphone array through an encoder, a decoder, to a set of 3D speakers according to embodiments of the present disclosure.

For example, FIG. 1A is an overall, high-level block diagram of an embodiment of the present disclosure illustrating the flow of information from a microphone array 10 through an encoder 12, a decoder 14, to a 3D speaker arrangement 16. Sound field 2 impinges on the microphone array 10 which produces a microphone signal ("$P_{in}$"). The microphone signal may be a six channel signal. The encoder 12 converts $P_{in}$ to an encoded signal ("$S_{out}$"). The encoded signal is sent to the decoder 14 which produces a decoded signal ("$P_{out}$"). $P_{out}$ is applied to the 3D speaker arrangement 16 to produce a 3D sound field that is an accurate reproduction of the sound field 2.

Figure 1B:
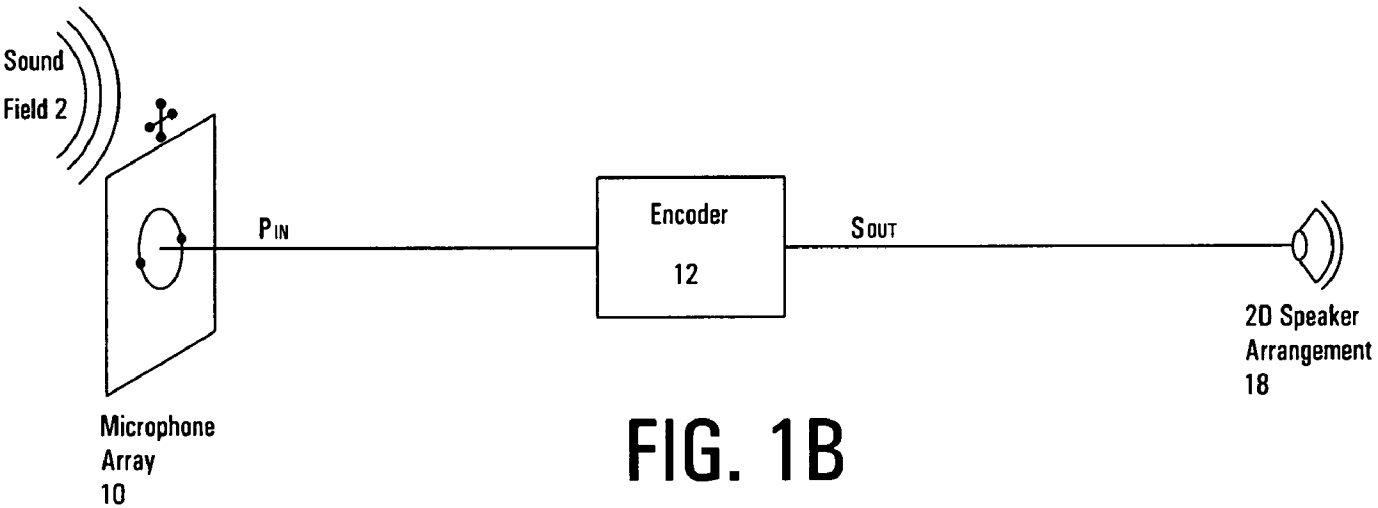
FIG. 1B is a high level block diagram illustrating the flow of information from a microphone array through an encoder to a set of 2D speakers according to embodiments of the present disclosure.

FIG. 1B is an overall, high-level block diagram of an embodiment of the present disclosure illustrating the flow of information from a microphone array 10 through an encoder 12 to a 2D speaker arrangement 18. Sound field 2 impinges on the microphone array 10 which produces a microphone signal ("$P_{in}$"). The microphone signal may be a six channel signal. The encoder 12 converts $P_{in}$ to an encoded signal ("$S_{out}$"). The encoded signal is applied to the 2D speaker arrangement 18 to produce a 2D sound field that is a representation of the sound field 2.

The details of the components of the systems in FIGS. 1A and 1B will be discussed below.

Microphone Array

Embodiments of the present invention may include a specialized microphone array for recording the necessary information of the sound field 2 so as to accurately reproduce the sound field with a speaker arrangement.

Figure 2A:
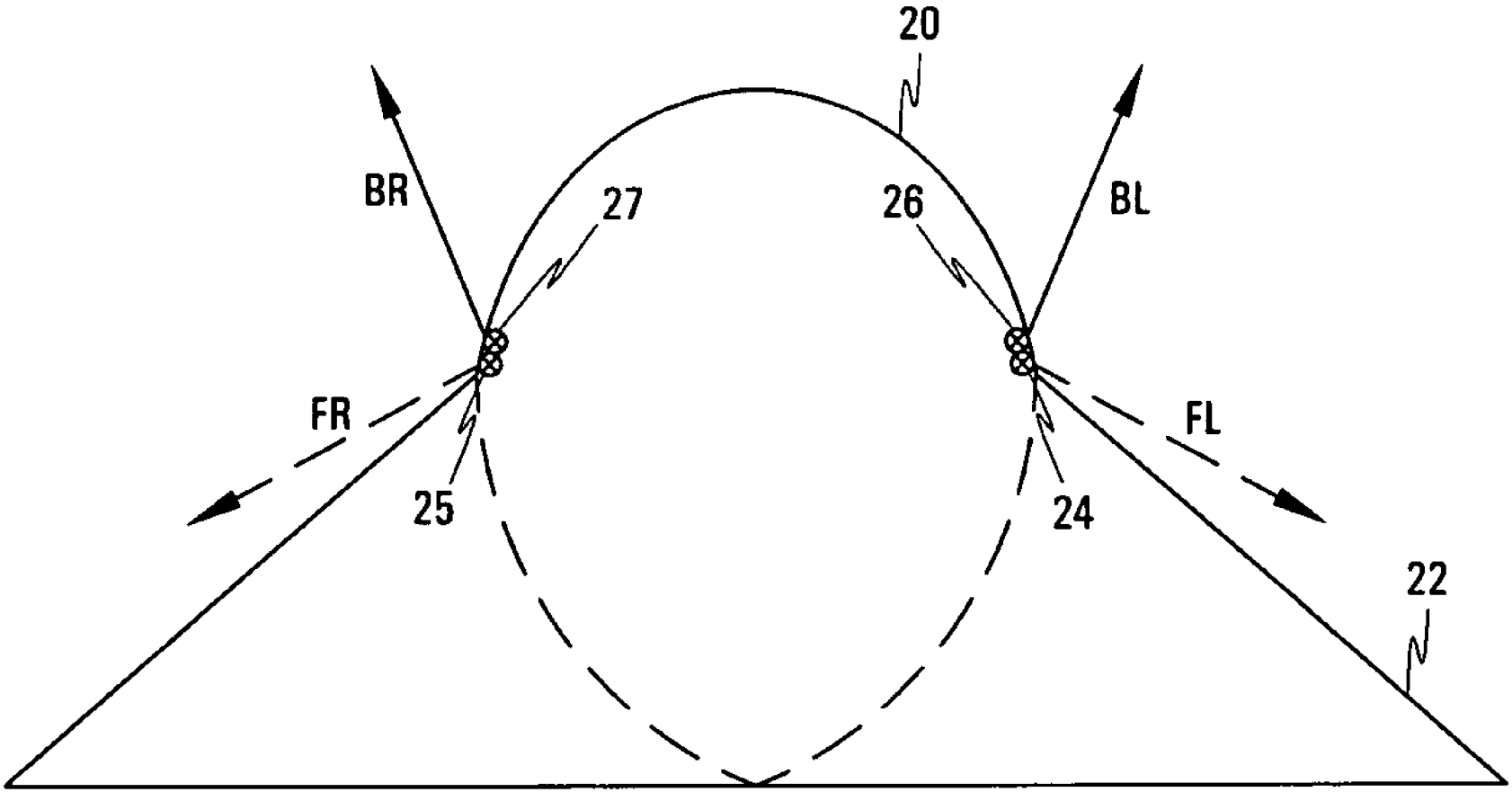
Figure 2B:
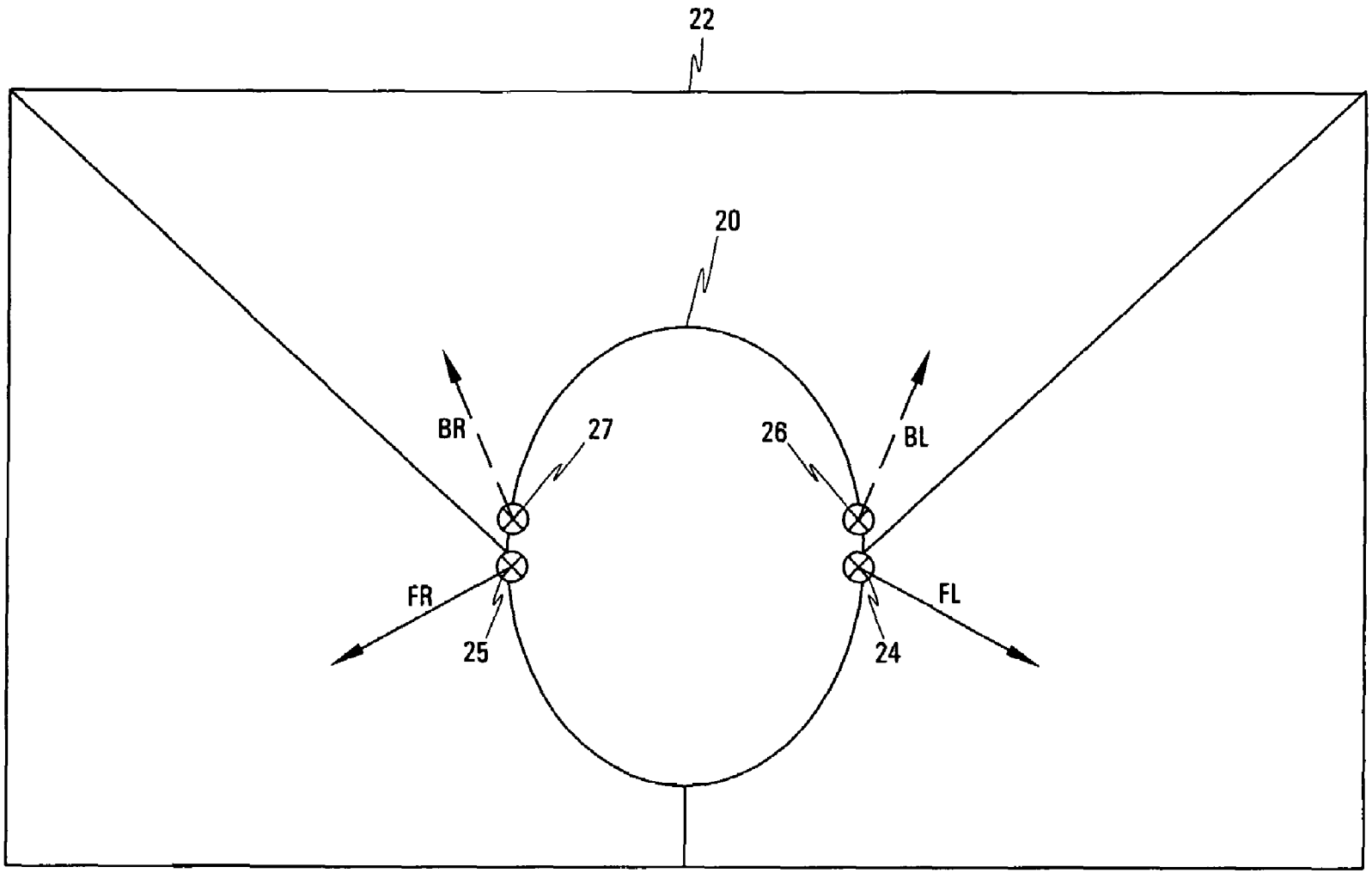

FIGS. 2A-2C depict a novel microphone array according to embodiments of the present disclosure. The microphone array, sometimes referred to as the "PerAmbio 3D/2D microphone array" is a hybrid array comprising a "soundfield" array for four Ambisonic signals (W, X, Y, Z), also know as B-Format channels, and a baffled, substantially ellipsoidal array for Ambiophonic signals (FL, FR, BL, BR).

1st order so-called "B-format" Ambisonic signals, called W, X, Y, and Z, represent pressure (omni-directional), and forward-, leftward-, and upward-facing pressure-gradient (velocity) microphone elements, respectively, as is known in prior art. The B-format signals in combination can approximately represent the sound of plane waves arriving at a listener from any direction in 3-dimensions. They contribute the "ambience" component of PerAmbio 3D/2D.

An ellipsoid 20 is approximately head-shaped and contributes that portion of human HRTF (head related transfer function) that can be successfully generalized—the human head spacing and "shadowing" between the ears. Head-spacing causes time delay, or interaural time delay ("ITD") while the head-shadowing describes the loss of level at frequencies greater than approximately 700 Hz, known as interaural level difference ("ILD"), of sounds originating from the side of the head opposite each ear. The inventive microphone array is designed with its imprimatur for these aspects of HRTF because they are similar in nearly all individuals. They contribute a great deal to horizontal localization of sounds—but not all. As discussed above, learned through experience, a listener's individual pinna cues must agree with head size and shadowing cues, or the listener is confused, and deems the sound not lifelike. The pinna are highly individual unlike prior art microphone arrays which use a dummy head with a "standard" pinna configuration. Since the inventive microphone array is pinnaless, the only "pinna" in the system are the listener's.

The microphone baffling 22 attenuates sounds from behind and above in order to avoid interference with the soundfield array that might otherwise cause undesirable ambiguous images and comb filtering for critical frontal sounds. FIGS. 2A-2C show a horizontal and vertical frontal acceptance angle. In one preferred embodiment, the horizontal frontal acceptance angle is 120 and the vertical frontal acceptance angel is 150. Side and top baffles use the boundary-layer effect with small microphone diaphragms located at the intersection of these planes and the "plane" tangent to the ellipsoid. This avoids high frequency reflections that otherwise would cause undesirable comb filtering and smearing of the microphone's impulse response, which is critically important in this application. The baffles provide 6 dB of acoustic gain above 500 Hz, which, when compensated with equalization, result in a +6 dB increase in signal-to-noise above that frequency, and make possible the use of small diaphragm microphone elements. The microphone may weigh approximately 7 kg (15 lb) and can be mounted on a stand or suspended and tilted as needed.

Microphone positions are designated on FIGS. 2A-2C as FL (front left) 24, FR (front right) 25, BL (back left) 26, and BR (back right) 27. The vectors associated with FL, FR, BL, and BR indicate the general direction of sound which impinges on each of the microphones. In embodiments of the microphone array which use 6 channels, either the FL, FR microphone pair or a mix adding the FL, FR pair to the BL, BR microphone pair, is used. When all four microphones are in use, an additional pair of channels is needed.

For compatibility with ITU-R BS.775.1 two dimensional surround systems, the microphone array may be fitted with the BL, BR microphone pair on the back of the baffle and may be positioned in coincidence (approximately 25 mm or less in 3-dimensional space) from the frontal pair (FL, FR). For anechoic recordings such as out of doors, the baffle may be typically flat and the horizontal and vertical acceptance angles are therefore 180 in front or back. Recordings made with the FL, FR, BL, BR microphones are compatible with standard ITU 5.1/6.1 systems. Playback in home theaters with ITU 5.1/6.1 systems, as discussed previously, results in two dimensional surround sound accurate over 360 when played using two cross-talk cancelled stereo dipoles (front and back). Playback can be three dimensional, with an appropriate speaker arrangement, if the B-format microphone signals are captured as well. PerAmbio three dimensional B-format signals may also be generated post-production using hall impulse responses and convolution of the front Ambiophone channels. The PerAmbio outputs of the present invention may be augmented with "spot" microphones highlighting individual instruments as desired by the recording or mixing engineer using methods specific to the present invention.

2D/3D Playback System

The present disclosure describes an encoder for "transformation" processing of 3D recordings in a form compatible with standard ITU 5.1/6.1 systems such that no decoder is needed. In doing so, the mastering engineer may select a useful "mode" that mathematically maps the height information in a way that most suits the performance or venue, e.g., opera, recital, arena concert, movie scene, etc. Eighty combinations of transformation modes are possible, but only a dozen or so are useful to the experienced recording engineer. The transformation mode selected by the recording engineer is reversible and changeable by the mastering engineer during preparations for mass distribution on CD or DVD media, for example. Transformation makes possible not just uncompromised, but potentially improved, 5.1/6.1, CD, DVD, etc. two dimensional media that contains embedded information for lossless 3D "reconstitution", described below, for example, when a listener adds a 3D decoder and 3D speaker arrangement.

When the user elects to expand to three dimensional sound from a prior art two dimensional system, he adds a "reconstitution" decoder 14 of the present invention, or a receiver/audio controller so-equipped. The reconstitution decoder 14 both: (a) recovers the three dimensional information according to the mode selected by the recording engineer; and (b) develops outputs for feeding, for example, 10, 14, or 26 loudspeakers, including four or more above and below the horizontal plane, depending on the user's resources. In DVD-A, the transformation mode selected by the recording engineer could be encoded in meta-data such that the user's receiver/decoder 14 could automatically select the mode for reconstitution. In addition, the transformation "mode" selected by the recording engineer or mastering engineer, is reversible and changeable by the advanced user as desired in order to enhance reproduction in two dimensional ITU 5.1/6.1 systems. The reconstitution decoder 14 of the present invention has been realized in DSP (digital signal processing) prototype form, has been demonstrated, and is ready as software for a programmable DSP chip ready for manufacture of consumer receivers and professional decoders.

Figure 6:
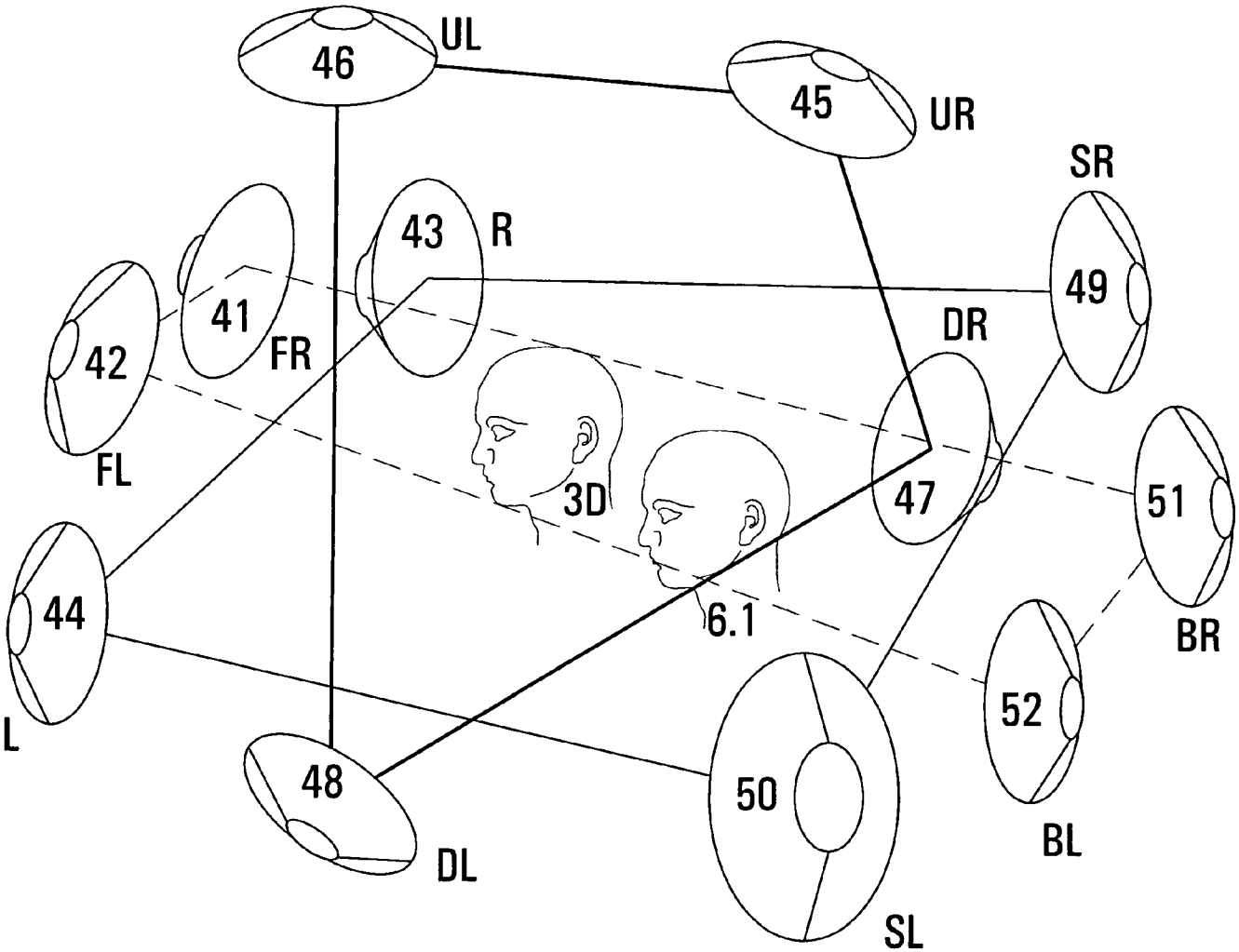
FIG. 6 is an illustration of a speaker layout for an embodiment of the present disclosure.

In addition to adding a reconstitution decoder 14, in order to get true 3D reproduction, the user must add, for example, four or five or more speakers (and power amplifiers) for a total of 10, 14, or 26 depending on the user's resources. Ten speakers is the experimentally determined minimum for lifelike results. Referring now to FIG. 6, which is a depiction of a twelve speaker arrangement according to an embodiment of the present disclosure, the two frontal speakers (41, 42) typically are of higher quality and power than the eight ambience speakers (43, 44, 45, 46, 47, 48, 49, 50) and two back speakers (51, 52) which may be of "satellite-quality" and lower in power. Speaker locations are somewhat flexible with decreasing quality of results if varied from recommended positions of the present invention. Whether in the recommended positions or not, the reconstitution decoder 14 of the present invention may be programmed by the user to reflect the exact loudspeaker locations during setup. The "Listening Area" ("Sweet Spot") is enlarged due to the hybrid nature of the present invention to accommodate 6 persons or more in a space of size commonly used for home theaters.

Encoder

FIGS. 3A-3F depict six possible transform modes the inventor has identified as useful. If metadata permitted, the recording engineer could have available all 80 combinations ($3^4$-1) considered for encoding 3D directionality into 6 full-range ITU compatible media channels for direct replay in 5.1/6.1. For 3D replay, decoding corresponding to the recording mode is implemented preferably in a DSP chip, but other implementations are contemplated. It may also be possible for users to download new matrices via the Internet.

The inventor has identified six useful "modes" for use in situations such as music recording, cinema ambience, multichannel broadcast, etc. A mode chosen during recording may be changed in post-production, or by a user with a "smart decoder" reconstituting original channels and making a new transformation. Changing the tilt of a raised (suspended) microphone is also easily done. For example, in DVD-A mastering, a flag is set in meta data of the tri-play 3D/2D disc for automatic selection by replay equipment.

Figure 3A:
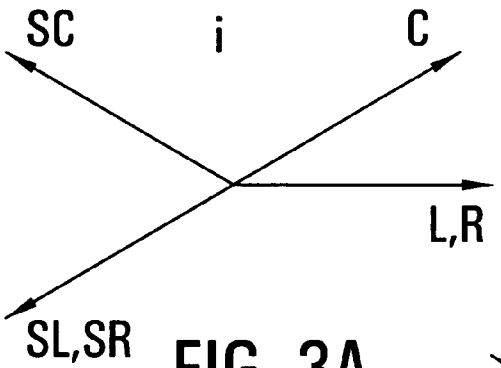
FIGS. 3A-3F each depict one of six transform modes according to aspects of the present disclosure.

For ease of use, mnemonics describe the three basic modes, i (FIG. 3A), j (FIG. 3B), & k (FIG. 3C), in terms of ITU 5.1/6.1 channels C (center), SC (surround center), SL (surround left), SR (surround right), L (left), and R (right), illustrated as follows with the source of sound to the right:

FIG. 3A: "i" represents C and SC "inclined" upward while SL and SR incline downward.

Figure 3B:
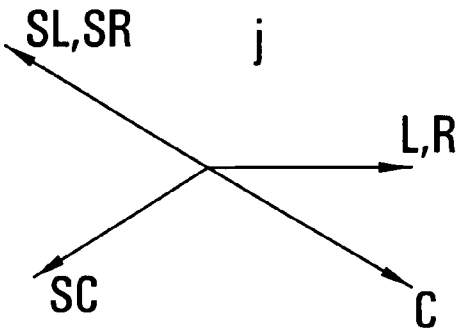

FIG. 3B: "j" "juxtaposes" the C, SC, SL, and SR channels from "i".

Figure 3C:
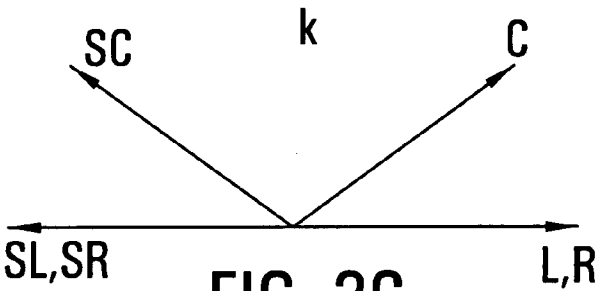

FIG. 3C: "k" is lying on its back with has C and SC angling upward from the corner channels (L, R, SL, SR) which lie flat.

Three tilted variants i' (FIG. 3D), j' (FIG. 3E), and k' (FIG. 3F) rotate C, SC, SL, and SR with respect to L, R by any practical angle, e.g. −30°, in order to raise the microphone (suspended or on a high stand). The output of the baffled ambiophone varies only slightly with height incidence, so physical tilting is inconsequential for the FL, FR or BL, BR channels.

From experience, recording engineers might identify applications described below for each of the six modes (keeping in mind they can be changed in post or replay):

FIG. 3A ("i"): the microphone array is placed at source level (L, R), below acoustic shell reflections (C), e.g. an outdoor amphitheater event, with audience.

FIG. 3B ("i'"): the array is on a high stand or hanging in an opera house or symphony hall, the orchestra widely spaced in a pit or strings downstage (L, R), singers or winds upstage (C), hall ambience back (SL, SR) & up (SC).

FIG. 3C ("j"): the array is more closely placed before a small ensemble at source level for direct sound and early floor and sidewall reflections (L, R), higher direct solo and ceiling reflections (C), and hall ambience from back-up (SL, SR) and back-down (SC).

Figure 3D:
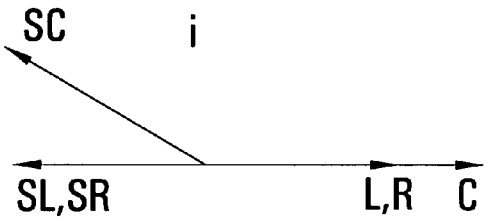

FIG. 3D ("j'"): the array hangs closer to a proscenium to pickup downstage sounds (L, R), upstage drama (C), high-back ambience (SL, SR), and audience (SC).

Figure 3E:
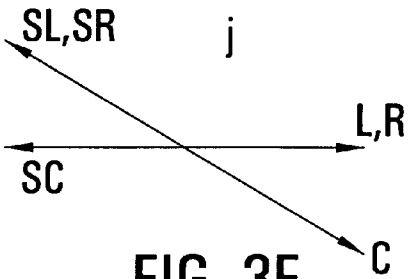

FIG. 3E ("k"): the microphone array is in an arena with sports play-action or musical instruments at microphone level (L, R), and with good high-front (C) and back (SC) crowd sounds or ceiling ambience.

Figure 3F:
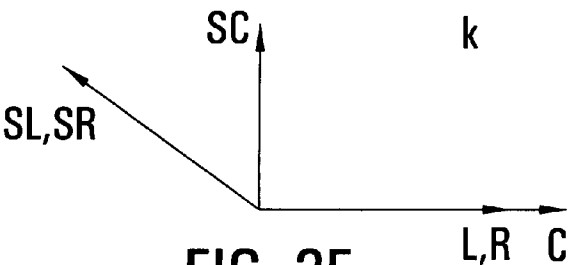

FIG. 3F ("k'"): the array is suspended in a cathedral with upstage choir (C) and front-of-church organ divisions and floor reflections (L, R), antiphonal and congregation in back (SL, SR), and organ trumpet overhead (SC).

After recording six PerAmbio 3D channels, given as {Pin} in 6×1 matrix form, a "transformation" matrix {S}:

$$\begin{vmatrix} s(L, FL) & s(L, FR) & s(L, W) & s(L, X) & s(L, Y) & s(L, Z) \\ s(R, FL) & s(R, FR) & s(R, W) & s(R, X) & s(R, Y) & s(R, Z) \\ s(C, FL) & s(C, FR) & s(C, W) & s(C, X) & s(C, Y) & s(C, Z) \\ s(SC, FL) & s(SC, FR) & s(SC, W) & s(SC, X) & s(SC, Y) & s(SC, Z) \\ s(SL, FL) & s(SL, FR) & s(SL, W) & s(SL, X) & s(SL, Y) & s(SL, Z) \\ s(SR, FL) & s(SR, FR) & s(SR, W) & s(SR, X) & s(SR, Y) & s(SR, Z) \end{vmatrix}$$

is applied to obtain the six ITU-compatible media channels {Sout} as follows:

$$\{Sout\}=\{S\}\cdot\{Pin\}$$

where:

$$\{S\} \text{ is defined above, } \{Sout\} \text{ is } \begin{vmatrix} L \\ R \\ C \\ SC \\ SL \\ SR \end{vmatrix} \text{ and } \{Pin\} \text{ is } \begin{vmatrix} FL \\ FR \\ W \\ X \\ Y \\ Z \end{vmatrix}$$

For a standard ITU home theater surround system, a multichannel disc (6 discrete channel DVD-A, SACD, or DTS-CDIDVD-V) plays {Sout} directly in 5.1/6.1. If the speaker layout is 5.1, current implementations sum SC information into SL and SR speaker feeds at −3 dB.

When the user augments his system for 3D, a "reconstitution" matrix {P} is applied, which may be implemented in DSP, in response to flags in meta data that select one of six recording modes to recover losslessly PerAmbio 3D—in matrix form {Pout}—as follows:

$$\{Pout\}=\{P\}\cdot\{Sout\}$$

Since matrix {P} is the inverse of matrix {S}, $$\{Pout\}=\{S\}^{-1}\cdot\{Sout\}$$

PerAmbio 3D reconstitution is lossless if $$\{Pout\}=\{Pin\}.$$

Experiments have led to improved matrices for the six transformation modes depicted in FIGS. 3A-3F. These matrices are shown in FIGS. 4A-4F, respectively.

Decoder

In order to play back the encoded channels in 3D, the encoded signals must be decoded. For example, if a user chooses to install 3D speakers, power amplifiers, etc., in order to reproduce the 3D sound field, a "reconstitution" decoder must also be added as shown in FIG. 1A. The decoder applies the inverse of the transformation matrix, or "reconstitution matrix" chosen for the recording. The reconstitution matrices for the transformation matrices in FIGS. 4A-4F are shown in FIGS. 5A-5F, respectively.

Speaker Arrangements

FIG. 6 depicts a recommended loudspeaker position for a preferred embodiment of the inventive system using 12 speakers. Another preferred embodiment uses ten speakers comprising all the speakers in FIG. 6 with the exception of the BL and BR speakers. In the loudspeaker positions of the depicted embodiment, the present inventive system is compatible playing existing two dimensional recordings made in ITU 5.1 or 6.1 format by moving backward 26% of the speaker diameter, the relative positions of 2 dimensional speakers to the listener are in full compliance with standard ITU-R775. Best results also require changing levels and delays of the four to six speakers affected, which could be a programmable function of DSP in the receiver/audio controller. Thus, the present invention offers full forward as well as backward compatibility between two dimensional and three dimensional recordings for all home theater users both before they expand their systems to three dimensions and thereafter.

In a preferred 10-speaker arrangement, the speakers are arranged as follows:

The FL, FR speakers are positioned so that:

azimuthally, one is approximately 8 degrees to the left of and the other is approximately 8 degrees to the right of the 12 o'clock position (i.e., directly in front) of a listener; and elevationally, both are positioned substantially on a horizontal plane that intersects the listener's ears.

The L, R speakers are positioned so that:

azimuthally, one is approximately 45 degrees to the left of and the other is approximately 45 degrees to the right of the 12 o'clock position of the listener; and elevationally, both are positioned substantially on said horizontal plane.

The SL, SR speakers are positioned so that:

azimuthally, one is approximately 135 degrees to the left of and the other is approximately 135 degrees to the right of the 12 o'clock position of the listener; and elevationally, both are positioned substantially on said horizontal plane.

The UL, UR speakers are positioned so that:

azimuthally, one is approximately 90 degrees to the left of and the other is approximately 90 degrees to the right of the 12 o'clock position of the listener; and elevationally, both are positioned above said horizontal plane.

The DL, DR speakers are positioned so that:

azimuthally, one is approximately 90 degrees to the left of and the other is approximately 90 degrees to the right of the 12 o'clock position of the listener; and elevationally, both are positioned below said horizontal plane.

In a preferred 12-speaker arrangement, the two speakers are added to the above arrangement as follows:

The BL, BR speakers are positioned so that:

azimuthally, one is approximately 172 degrees to the left of and the other is approximately 172 degrees to the right of the 12 o'clock position of a listener; and elevationally, both are positioned substantially on a horizontal plane that intersects the listener's ears.

Although the various aspects of the present invention have been described with respect to heir preferred embodiments, it will be understood that the present invention is entitled to protection within the full scope of the appended claims.

I claim:

1. A system for producing an output sound field that is representative of an input sound field, comprising:

a microphone array for receiving the input sound field and producing therefrom a microphone signal ("$P_{in}$") representative of the input sound field wherein $P_{in}$ comprises B-format channels, an FL (front left) channel, and an FR (front right) channel; an encoder for producing an encoded signal ("S.sub.out") from P.sub.in using a transformation matrix S, such that S.sub.out=*P.sub.in wherein $S_{out}$ comprises an ITU-compatible six channel signal; a decoder for producing a decoded signal ("$P_{out}$") from $S_{out}$ wherein $P_{out}$ comprises B-format channels, an FL channel, and an FR channel; and a plurality of speakers for producing the output sound field from $P_{out}$, wherein S is the matrix comprising the quantities: s (L, FL) s (L, FR) S (L, W) s (L, X) s (L, Y) s (L, ) s (R, FL) s (R, FR) s (R, W) s (R, X) s (R, Y) s (R, Z) s (C, FL) s (C, FR) s (C, W) s (C, X) s (C, Y) s (C, Z) s (SC, FL) s (SC, FR) s (SC, W) s (SC, X) s (SC, Y) s (SC, Z) s (SL, FL) s (SL, FR) s (SL, W) s (SL, X) s (SL, Y) s (SL, Z) s (SR, FL) s (SF, FR) s (SR, W) s (SR, X) s (SR, Y) s (SR, Z)

wherein:

L represents a left speaker channel for an ITU-compatible six channel signal;

R represents a right speaker channel for an ITU-compatible six channel signal;

C represents a center speaker channel for an ITU-compatible six channel signal;

SC represents a surround center speaker channel for an ITU-compatible six channel signal;

SL represents a surround left speaker channel for an ITU-compatible six channel signal;

SR represents a surround right speaker channel for an ITU-compatible six channel signal;

FL represents the front left speaker channel;

FR represents the front right speaker channel;

W represents a B-format channel;

X represents a B-format channel;

Y represents a B-format channel;

Z represents a B-format channel;

and wherein $s(\alpha,\beta)$ represents a transformation quantity relating the respective $\alpha$ and $\beta$ channels.

2. The system of claim 1 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & .425 \\ 0 & 0 & .601 & -.736 & 0 & .425 \\ 0 & 0 & .601 & -.368 & .638 & -.425 \\ 0 & 0 & .601 & -.368 & -.638 & -.425 \end{vmatrix}.$$

3. The system of claim 1 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & -.425 \\ 0 & 0 & .601 & -.736 & 0 & -.425 \\ 0 & 0 & .601 & -.368 & .638 & .425 \\ 0 & 0 & .601 & -.368 & -.638 & .425 \end{vmatrix}.$$

4. The system of claim 1 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & .425 \\ 0 & 0 & .601 & -.425 & 0 & .736 \\ 0 & 0 & .601 & -.425 & .736 & 0 \\ 0 & 0 & .601 & -.425 & -.736 & 0 \end{vmatrix}.$$

5. The system of claim 1 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .850 & 0 & 0 \\ 0 & 0 & .601 & -.425 & 0 & .736 \\ 0 & 0 & .601 & -.531 & .638 & -.184 \\ 0 & 0 & .601 & -.531 & -.638 & -.184 \end{vmatrix}.$$

6. The system of claim 1 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .425 & 0 & -.736 \\ 0 & 0 & .601 & -.850 & 0 & 0 \\ 0 & 0 & .601 & -.106 & .638 & .552 \\ 0 & 0 & .601 & -.106 & -.638 & .552 \end{vmatrix}.$$

7. The system of claim 1 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .850 & 0 & 0 \\ 0 & 0 & .601 & 0 & 0 & .850 \\ 0 & 0 & .601 & -.368 & .736 & .213 \\ 0 & 0 & .601 & -.368 & -.736 & .213 \end{vmatrix}.$$

8. A system for producing an output sound field that is representative of an input sound field, comprising:

a microphone array for receiving the input sound field and producing therefrom a microphone signal ("$P_{in}$") representative of the input sound field wherein $P_{in}$ comprises B-format channels, an FL (front left) channel, and an FR (front right) channel; an encoder for producing an encoded signal ("S.sub.out") from P.sub.in using a transformation matrix S, such that S.sub.out=*P.sub.in wherein $S_{out}$ comprises an ITU-compatible six channel signal; a decoder for producing a decoded signal ("$P_{out}$") from $S_{out}$ wherein $P_{out}$ comprises B-format channels, an FL channel, and an FR channel; and a plurality of speakers for producing the output sound field from $P_{out}$, wherein:

a first two of said speakers are positioned so that:

azimuthally, one is approximately 8 degrees to the left of and the other is approximately 8 degrees to the right of the 12 o'clock position of a listener; and elevationally, both are positioned substantially on a horizontal plane that intersects the listener's ears; a second two of said speakers are positioned so that:

azimuthally, one is approximately 45 degrees to the left of and the other is approximately 45 degrees to the right of the 12 o'clock position of the listener; and elevationally, both are positioned substantially on said horizontal plane;

a third two of said speakers are positioned so that:

azimuthally, one is approximately 135 degrees to the left of and the other is approximately 135 degrees to the right of the 12 o'clock position of the listener;

and elevationally, both are positioned substantially on said horizontal plane;

a fourth two of said speakers are positioned so that:

azimuthally, one is approximately 90 degrees to the left of and the other is approximately 90 degrees to the right of the 12 o'clock position of the listener; and elevationally, both are positioned above said horizontal plane; and a fifth two of said speakers are positioned so that:

azimuthally, one is approximately 90 degrees to the left of and the other is approximately 90 degrees to the right of the 12 o'clock position of the listener; and elevationally, both are positioned below said horizontal plane.

9. The system of claim 8 further comprising at least two additional speakers.

10. The system of claim 9 wherein:

sixth two of said speakers are positioned so that:

azimuthally, one is approximately 172 degrees to the left of and the other is approximately 172 degrees to the right of the 12 o'clock position of a listener; and elevationally, both are positioned substantially on a horizontal plane that intersects the listener's ears.

11. A system for providing an encoded signal ("$S_{out}$") representative of an input sound field, comprising:

a microphone array for receiving the input sound field and producing therefrom a microphone signal ("$P_{in}$") representative of the input sound field wherein $P_{in}$ comprises B-format channels, an FL (front left) channel, and an FR (front right) channel; an encoder for producing an encoded signal ("S.sub.out") from P.sub.in using a transformation matrix S, such that S.sub.out=*P.sub.in wherein $S_{out}$ comprises an ITU-compatible six channel signal, wherein S comprises the quantities:

wherein S is the matrix comprising the quantities: s (L, FL) s (L, FR) S (L, W) s (L, X) s (L, Y) s (L, ) s (R, FL) s (R, FR) s (R, W) s (R, X) s (R, Y) s (R, Z) s (C, FL) s (C, FR) s (C, W) s (C, X) s (C, Y) s (C, Z) s (SC, FL) s (SC, FR) s (SC, W) s (SC, X) s (SC, Y) s (SC, Z) s (SL, FL) s (SL, FR) s (SL, W) s (SL, X) s (SL, Y) s (SL, Z) s (SR, FL) s (SF, FR) s (SR, W) s (SR, X) s (SR, Y) s (SR, Z)

wherein:

L represents a left speaker channel for an ITU-compatible six channel signal;

R represents a right speaker channel for an ITU-compatible six channel signal;

C represents a center speaker channel for an ITU-compatible six channel signal;

SC represents a surround center speaker channel for an ITU-compatible six channel signal;

SL represents a surround left speaker channel for an ITU-compatible six channel signal;

SR represents a surround right speaker channel for an ITU-compatible six channel signal;

FL represents the front left speaker channel;

FR represents the front right speaker channel;

W represents a B-format channel;

X represents a B-format channel;

Y represents a B-format channel;

Z represents a B-format channel;

wherein s(α, β) represents a transformation quantity relating the respective α and β channels, wherein the hybrid microphone array is comprised of:

at least 6 microphones; and a baffle including a substantially ellipsoidal structure.

12. The system of claim 11 wherein four of said microphones are arranged in a tetrahedron.

13. The system of claim 11 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & .425 \\ 0 & 0 & .601 & -.736 & 0 & .425 \\ 0 & 0 & .601 & -.368 & .638 & -.425 \\ 0 & 0 & .601 & -.368 & -.638 & -.425 \end{vmatrix}.$$

14. The system of claim 11 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & -.425 \\ 0 & 0 & .601 & -.736 & 0 & -.425 \\ 0 & 0 & .601 & -.368 & .638 & .425 \\ 0 & 0 & .601 & -.368 & -.638 & .425 \end{vmatrix}.$$

15. The system of claim 11 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & .425 \\ 0 & 0 & .601 & -.425 & 0 & .736 \\ 0 & 0 & .601 & -.425 & .736 & 0 \\ 0 & 0 & .601 & -.425 & -.736 & 0 \end{vmatrix}.$$

16. The system of claim 11 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .850 & 0 & 0 \\ 0 & 0 & .601 & -.425 & 0 & .736 \\ 0 & 0 & .601 & -.531 & .638 & -.184 \\ 0 & 0 & .601 & -.531 & -.638 & -.184 \end{vmatrix}.$$

17. The system of claim 11 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .425 & 0 & -.736 \\ 0 & 0 & .601 & -.850 & 0 & 0 \\ 0 & 0 & .601 & -.106 & .638 & .552 \\ 0 & 0 & .601 & -.106 & -.638 & .552 \end{vmatrix}.$$

18. The system of claim 11 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .850 & 0 & 0 \\ 0 & 0 & .601 & 0 & 0 & .850 \\ 0 & 0 & .601 & -.368 & .736 & .213 \\ 0 & 0 & .601 & -.368 & -.736 & .213 \end{vmatrix}.$$

19. A method for producing an output sound field that is representative of an input sound field, comprising the steps of:

providing a microphone array for receiving the input sound field and producing therefrom a microphone signal ("$P_{in}$") representative of the input sound field wherein $P_{in}$ comprises B-format channels, an FL channel, and an FR channel; an encoder for producing an encoded signal ("S.sub.out") from P.sub.in using a transformation matrix S, such that S.sub.out=*P.sub.in wherein $S_{out}$ comprises an ITU-compatible six channel signal; producing a decoded signal ("$P_{out}$") from $S_{out}$ wherein $P_{out}$ comprises B-format channels, an FL channel, and an FR channel; and providing a plurality of speakers for producing the output sound field from $P_{out}$ to thereby represent the input sound field, wherein S is the matrix comprising the quantities: s (L, FL) s (L, FR) S (L, W) s (L, X) s (L, Y) s (L, ) s (R, FL) s (R, FR) s (R, W) s (R, X) s (R, Y) s (R, Z) s (C, FL) s (C, FR) s (C, W) s (C, X) s (C, Y) s (C, Z) s (SC, FL) s (SC, FR) s (SC, W) s (SC, X) s (SC, Y) s (SC, Z) s (SL, FL) s (SL, FR) s (SL, W) s (SL, X) s (SL, Y) s (SL, Z) s (SR, FL) s (SF, FR) s (SR, W) s (SR, X) s (SR, Y) s (SR, Z)

wherein:

L represents a left speaker channel for an ITU-compatible six channel signal;

R represents a right speaker channel for an ITU-compatible six channel signal;

C represents a center speaker channel for an ITU-compatible six channel signal;

SC represents a surround center speaker channel for an ITU-compatible six channel signal;

SL represents a surround left speaker channel for an ITU-compatible six channel signal;

SR represents a surround right speaker channel for an ITU-compatible six channel signal;

FL represents the front left speaker channel;

FR represents the front right speaker channel;

W represents a B-format channel;

X represents a B-format channel;

Y represents a B-format channel;

Z represents a B-format channel;

wherein s(α, β) represents a transformation quantity relating the respective α and β channels, and wherein the hybrid microphone array is comprised of:

at least 6 microphones; and a substantially ellipsoidal baffle.

20. The method of claim 19 wherein four of said microphones are arranged in a tetrahedron.

21. The method of claim 20 wherein the plurality of speakers produces the output sound field from $S_{out}$.

22. The method of claim 21 wherein the plurality of speakers are provided in a 2D arrangement.

23. The method of claim 19 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & .425 \\ 0 & 0 & .601 & -.736 & 0 & .425 \\ 0 & 0 & .601 & -.368 & .638 & -.425 \\ 0 & 0 & .601 & -.368 & -.638 & -.425 \end{vmatrix}.$$

24. The method of claim 19 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & -.425 \\ 0 & 0 & .601 & -.736 & 0 & -.425 \\ 0 & 0 & .601 & -.368 & .638 & .425 \\ 0 & 0 & .601 & -.368 & -.638 & .425 \end{vmatrix}.$$

25. The method of claim 19 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & .425 \\ 0 & 0 & .601 & -.425 & 0 & .736 \\ 0 & 0 & .601 & -.425 & .736 & 0 \\ 0 & 0 & .601 & -.425 & -.736 & 0 \end{vmatrix}.$$

26. The method of claim 19 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .850 & 0 & 0 \\ 0 & 0 & .601 & -.425 & 0 & .736 \\ 0 & 0 & .601 & -.531 & .638 & -.184 \\ 0 & 0 & .601 & -.531 & -.638 & -.184 \end{vmatrix}.$$

27. The method of claim 19 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .425 & 0 & -.736 \\ 0 & 0 & .601 & -.850 & 0 & 0 \\ 0 & 0 & .601 & -.106 & .638 & .552 \\ 0 & 0 & .601 & -.106 & -.638 & .552 \end{vmatrix}.$$

28. The method of claim 19 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .850 & 0 & 0 \\ 0 & 0 & .601 & 0 & 0 & .850 \\ 0 & 0 & .601 & -.368 & .736 & .213 \\ 0 & 0 & .601 & -.368 & -.736 & .213 \end{vmatrix}.$$

29. A method for producing an output sound field that is representative of an input sound field, comprising the steps of:

providing a microphone array for receiving the input sound field and producing therefrom a microphone signal ("$P_{in}$") representative of the input sound field wherein $P_{in}$ comprises B-format channels, an FL channel, and an FR channel; producing an encoder for producing an encoded signal ("S.sub.out") from P.sub.in using a transformation matrix S, such that S.sub.out=*P.sub.in wherein $S_{out}$ comprises an ITU-compatible six channel signal; producing a decoded signal ("$P_{out}$") from $S_{out}$ wherein $P_{out}$ comprises B-format channels, an FL channel, and an FR channel; and providing a plurality of speakers for producing the output sound field from $P_{out}$ to thereby represent the input sound field wherein the hybrid microphone array is comprised of:

at least 6 microphones; and a substantially ellipsoidal baffle, wherein:

a first two of said speakers are positioned so that:

azimuthally, one is approximately 8 degrees to the left of and the other is approximately 8 degrees to the right of the 12 o'clock position of a listener; and elevationally, both are positioned substantially on a horizontal plane that intersects the listener's ears; a second two of said speakers are positioned so that:

azimuthally, one is approximately 45 degrees to the left of and the other is approximately 45 degrees to the right of the 12 o'clock position of the listener; and elevationally, both are positioned substantially on said horizontal plane;

a third two of said speakers are positioned so that:

azimuthally, one is approximately 135 degrees to the left of and the other is approximately 135 degrees to the right of the 12 o'clock position of the listener;

and elevationally, both are positioned substantially on said horizontal plane;

a fourth two of said speakers are positioned so that:

azimuthally, one is approximately 90 degrees to the left of and the other is approximately 90 degrees to the right of the 12 o'clock position of the listener; and elevationally, both are positioned above said horizontal plane; and a fifth two of said speakers are positioned so that:

azimuthally, one is approximately 90 degrees to the left of and the other is approximately 90 degrees to the right of the 12 o'clock position of the listener; and elevationally, both are positioned below said horizontal plane.

30. The method of claim 29 further comprising at least two additional speakers.

31. The method of claim 30 wherein:

a sixth two of said speakers are positioned so that:

azimuthally, one is approximately 172 degrees to the left of and the other is approximately 172 degrees to the right of the 12 o'clock position of a listener; and elevationally, both are positioned substantially on a horizontal plane that intersects the listener's ears.

32. A method for producing an encoded signal ("$S_{out}$") representative of an input sound field, comprising the steps:

providing a microphone array for receiving the input sound field and producing therefrom a microphone signal ("$P_{in}$") representative of the input sound field wherein $P_{in}$ comprises B-format channels, an FL (front left) channel, and an FR (front right) channel; an encoder for producing an encoded signal ("S.sub.out") from P.sub.in using a transformation matrix S, such that S.sub.out=*P.sub.in wherein $S_{out}$ comprises an ITU-compatible six channel signal wherein S is the matrix comprising the quantities: s (L, FL) s (L, FR) S (L, W) s (L, X) s (L, Y) s (L, ) s (R, FL) s (R, FR) s (R, W) s (R, X) s (R, Y) s (R, Z) s (C, FL) s (C, FR) s (C, W) s (C, X) s (C, Y) s (C, Z) s (SC, FL) s (SC, FR) s (SC, W) s (SC, X) s (SC, Y) s (SC, Z) s (SL, FL) s (SL, FR) s (SL, W) s (SL, X) s (SL, Y) s (SL, Z) s (SR, FL) s (SF, FR) s (SR, W) s (SR, X) s (SR, Y) s (SR, Z)

wherein:

L represents a left speaker channel for an ITU-compatible six channel signal;

R represents a right speaker channel for an ITU-compatible six channel signal;

C represents a center speaker channel for an ITU-compatible six channel signal;

SC represents a surround center speaker channel for an ITU-compatible six channel signal;

SL represents a surround left speaker channel for an ITU-compatible six channel signal;

SR represents a surround right speaker channel for an ITU-compatible six channel signal;

FL represents the front left speaker channel;

FR represents the front right speaker channel;

W represents a B-format channel;

X represents a B-format channel;

Y represents a B-format channel;

Z represents a B-format channel;

wherein $s(\alpha, \beta)$ represents a transformation quantity relating the respective $\alpha$ and $\beta$ channels, and wherein the hybrid microphone array is comprised of:

at least 6 microphones; and a substantially ellipsoidal shaped baffle.

33. The method of claim 32 wherein four of said microphones are arranged in a tetrahedron.

34. The method of claim 32 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & .425 \\ 0 & 0 & .601 & -.736 & 0 & .425 \\ 0 & 0 & .601 & -.368 & .638 & -.425 \\ 0 & 0 & .601 & -.368 & -.638 & -.425 \end{vmatrix}.$$

35. The method of claim 32 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & -.425 \\ 0 & 0 & .601 & -.736 & 0 & -.425 \\ 0 & 0 & .601 & -.368 & .638 & .425 \\ 0 & 0 & .601 & -.368 & -.638 & .425 \end{vmatrix}.$$

36. The method of claim 32 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .736 & 0 & .425 \\ 0 & 0 & .601 & -.425 & 0 & .736 \\ 0 & 0 & .601 & -.425 & .736 & 0 \\ 0 & 0 & .601 & -.425 & -.736 & 0 \end{vmatrix}.$$

37. The method of claim 32 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .850 & 0 & 0 \\ 0 & 0 & .601 & -.425 & 0 & .736 \\ 0 & 0 & .601 & -.531 & .638 & -.184 \\ 0 & 0 & .601 & -.531 & -.638 & -.184 \end{vmatrix}.$$

38. The method of claim 32 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .425 & 0 & -.736 \\ 0 & 0 & .601 & -.850 & 0 & 0 \\ 0 & 0 & .601 & -.106 & .638 & .552 \\ 0 & 0 & .601 & -.106 & -.638 & .552 \end{vmatrix}.$$

39. The method of claim 32 wherein S comprises the following approximate quantities:

$$\begin{vmatrix} .850 & 0 & 0 & 0 & 0 & 0 \\ 0 & .850 & 0 & 0 & 0 & 0 \\ 0 & 0 & .601 & .850 & 0 & 0 \\ 0 & 0 & .601 & 0 & 0 & .850 \\ 0 & 0 & .601 & -.368 & .736 & .213 \\ 0 & 0 & .601 & -.368 & -.736 & .213 \end{vmatrix}.$$

* * * * *